United States Patent [19]

Akisue et al.

[11] 4,315,783

[45] Feb. 16, 1982

[54] METHOD OF PRODUCING NON-AGEING COLD ROLLED STEEL STRIP WITH EXCELLENT DEEP-DRAWABILITY BY CONTINUOUS HEAT TREATMENT

[75] Inventors: Osamu Akisue; Teruaki Yamada, both of Himeji; Munetsugu Matsuo, Kawasaki; Norimasa Uehara, Kimitsu, all of Japan

[73] Assignee: Nippon Steel Corporation, Tokyo, Japan

[21] Appl. No.: 85,512

[22] Filed: Oct. 17, 1979

[30] Foreign Application Priority Data

Oct. 21, 1978 [JP] Japan ..... 53-129071

[51] Int. Cl.[3] ..... C21D 8/04

[52] U.S. Cl. ..... 148/12 C; 148/134

[58] Field of Search ..... 148/12 R, 12 C, 12 D, 148/12 F, 12.1, 12.4, 36, 134, 143, 144, 156

[56] References Cited

U.S. PATENT DOCUMENTS

| | | | |
|---|---|---|---|
| 3,256,119 | 6/1966 | Logan et al. | 148/144 |
| 3,765,874 | 10/1973 | Elias et al. | 148/36 |
| 3,821,031 | 6/1974 | Kubotera et al. | 148/12 C |
| 3,879,232 | 4/1975 | Gondo et al. | 148/12 C |
| 3,959,029 | 5/1976 | Madsudo et al. | 148/12 C |

*Primary Examiner*—Peter K. Skiff

*Attorney, Agent, or Firm*—Cushman, Darby & Cushman

[57] ABSTRACT

A method of producing a non-ageing cold rolled steel strip having excellent deep-drawability, with a $\bar{r}$ value of 1.5 or higher and ageing index of not higher than 3 kg/mm$^2$ from an Al-killed steel with a lowered carbon content between 0.001 and 0.0035% and with no special additives such as titanium by a relatively low temperature coiling in the hot rolling, and a short-time continuous annealing without over-ageing, thus over-coming the disadvantages caused by a high temperature coiling and by additional over-ageing.

6 Claims, 7 Drawing Figures

METHOD OF PRODUCING NON-AGEING COLD ROLLED STEEL STRIP WITH EXCELLENT DEEP-DRAWABILITY BY CONTINUOUS HEAT TREATMENT

BACKGROUND OF THE INVENTION

1. Field of the Invention

The present invention relates to a continuous heat treatment for producing a non-ageing cold rolled steel sheet or strip (hereinafter called simply strip) having excellent deep-drawability, and so far as steel compositions and conditions of hot rolling are within the scope of the present invention as defined hereinbelow, it is possible to produce a non-ageing cold rolled steel strip having excellent deep-drawability by a continuous heat treatment without an over-ageing treatment.

2. Description of Prior Art

According to prior arts for producing a cold rolled steel strip by a continuous annealing, the temperature of such continuous annealing is maintained not so high, and the annealing time is short so that it is possible to produce SPCC grade (JIS G3141) or SPCD grade (JIS G3141) only when the additional subsequent over-ageing treatment is performed, but there is no prior art which can obtain a non-ageing deep-drawing grade (SPCE: JIS G3141). Thus, there has never been developed an art which can produce at a low production cost a non-ageing deep-drawing steel strip by a continuous heat treatment without an over-ageing treatment.

Conventionally, a non-ageing cold rolled steel strip having excellent deep-drawability has been produced by cold rolling a killed steel and then box-annealing the cold rolled strip. However, the box-annealing requires several days from the heating to the cooling and thus is very disadvantageous in respect to the production efficiency.

In order to eliminate the disadvantage of the box-annealing, a continuous annealing method has been developed for production of a deep-drawing cold rolled steel strip, but this method requires very strict limitations in the steel composition such as addition of titanium etc. and lowering of the carbon content. Further this conventional continuous annealing method requires an over-ageing treatment after the annealing in order to obtain desired results, so that the annealing furnace requires a very long line, thus causing considerable increase in the capital cost, and the material quality obtainable by this conventional continuous annealing method has been found to be inferior to that obtainable by the box-annealing method.

Various methods have been known for production of non-ageing deep-drawing cold rolled steel strip.

For example, U.S. Pat. No. 3,522,110 discloses a method to fix with titanium the carbon and nitrogen which are causes of the ageing. According to embodiment of this prior art, the carbon content is lowered to a range from 0.003 to 0.017 for example, and titanium is added in an amount 4 times larger than the carbon content, and the steel is hot rolled at 780° C. or higher, acid-pickled, cold rolled with 30% or larger reduction and box-annealed at a temperature lower than 900° C. or continuously annealed between 750° C. and 1000° C. The r value obtainable by this prior art is very high and the resultant ageing index value is markedly low, thus providing a non-ageing cold rolled steel strip having excellent deep-drawability.

U.S. Pat. No. 3,821,031 discloses production of a deep-drawing cold rolled steel strip from Al-killed steel containing no titanium by a continuous annealing. According to this prior art, the carbon content in the steel is lowered to 0.004%, and the steel is hot rolled, coiled at a relatively high temperature between 670° C. and 700° C., cold rolled, continuously annealed in a soaking temperature ranging from 740° C. to 780° C. for 60 seconds, and held in a slow cooling temperature ranging from 520° C. to 400° C. for 80 seconds to effect over-ageing.

The $\bar{r}$ value obtainable by this prior art ranges from 1.42 to 1.46 and the ageing index value ranges from 4.2 to 5.0 kg/mm$^2$, thus inferior to those obtainable by U.S. Pat. No. 3,522,110, in which titanium is added to the steel.

The present inventors have made extensive researches and studies for producing the deep-drawing grade (SPCE) by a continuous annealing, and for simplifying and shortening the continuous annealing.

SUMMARY OF THE INVENTION

The present invention provides a method for producing a non-ageing steel strip having excellent deep-drawability and free from secondary work crackings by a continuous heat treatment without a subsequent over-ageing treatment, in which an extremely low carbon Al-killed steel (C 0.0010%–0.0035%, sol.Al: 0.015%–0.090%) is used and the coiling temperature in the hot rolling step is specified to a certain range. Further, according to the present invention, a rapid heating during the continuous heat treatment, and a large reduction in the cold rolling are employed separately or in combination to further improve the workability of the strip, and a low temperature slab heating is employed to obtain the non-ageing property in spite of a considerably low hot coiling temperature.

DETAILED DESCRIPTION OF THE INVENTION

The deep-drawability of steel strip is usually estimated by the $\bar{r}$ value (an average r value in the rolling direction, in the width direction and in the 45° direction). However, this $\bar{r}$ value considerably varies depending on the grain orientation and the mode of grain growth after the recrystallization. As one requirement for the deep-drawing steel sheet (SPCE), the $\bar{r}$ value must be not lower than 1.5. A further requirement for the non-ageing steel sheet is that the value of A.I. (ageing index: difference between the flow stress of an annealed steel sheet given 10% tension and that of the steel sheet after an ageing treatment at 100° C. for one hour) must be not larger than 3 kg/mm$^2$, preferably 1 kg/mm$^2$.

Another thing which must be avoided by all means for a cold rolled steel strip is the phenomenon of so-called secondary work cracking which is essentially a brittle fracture caused when a pressed steel material is subjected to further (secondary) working. This phenomenon has been said to take place when the amount of carbon in solid solution is decreased excessively by addition of Ti and Nb or by a low carbon content. Every means must be taken against this phenomenon in production of a non-ageing deep-drawing steel strip.

The present inventors have made various extensive studies for producing a cold rolled steel strip satisfying all of the above requirements for a non-ageing deep-drawing steel sheet and have made the following discoveries, on which the present invention is based.

For producing a cold rolled steel strip from an Al-killed steel containing 0.015% to 0.090% sol.Al, satisfying the above requirements: (1) a $\bar{r}$ value of not lower than 1.5; (2) A.I. of not larger than 3 kg/mm$^2$; and (3) no secondary work cracking; carbon content, among all, must be strictly controlled, and must be limited to the range from 0.0010% to 0.0035%. With this control being successful, all of the above three requirements can be almost fully satisfied. In order to still further satisfy the above requirements, it is necessary that the coiling temperature in the hot rolling is not lower than 580° C. (not lower than 530° C. in some cases under certain conditions). This is for the purpose of fixing nitrogen with Al as AlN.

Regarding the soaking temperature in annealing, it must be 680° C. or higher so as to assure the deep-drawability. With a higher soaking temperature, a higher $\bar{r}$ value can be obtained, but at soaking temperatures exceeding 900° C. all the grains transform into austenite and the recrystallized grain orientation becomes random so that the $\bar{r}$ value becomes very low. Therefore, the soaking temperature should be not higher than 900° C.

Regarding the manganese content, when it exceeds 0.45%, the deep-drawability abruptly lowers. Therefore, the manganese content must be not higher than 0.45%.

The present invention will be described referring to the attached drawings.

DESCRIPTION OF PREFERRED EMBODIMENT

Figure 1:
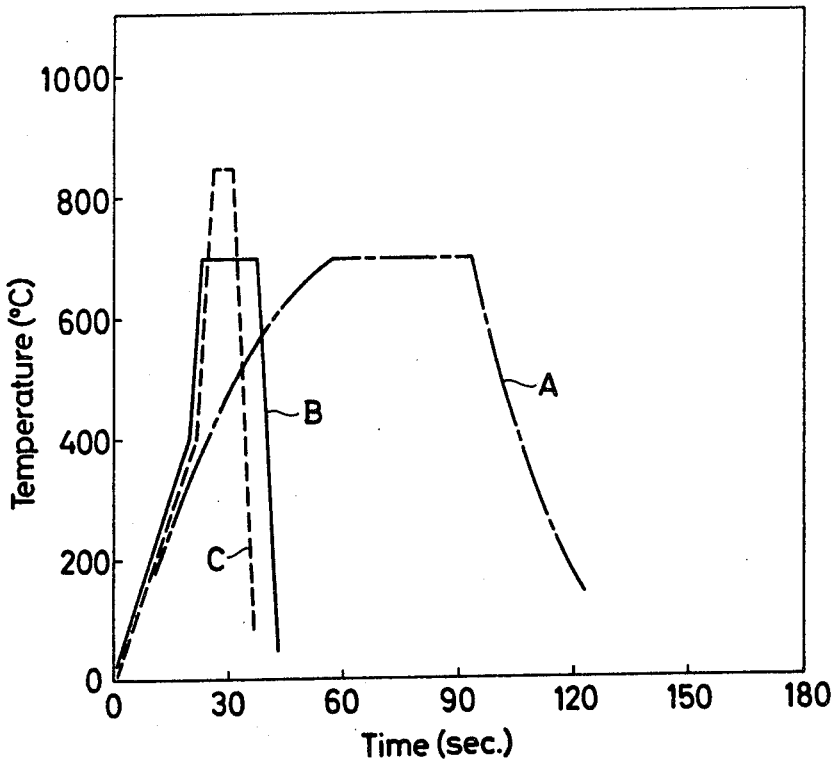
FIG. 1 is a graph showing heat patterns in the experimental heat treatments.

A steel containing 0.050 to 0.065% sol.Al, 0.0045 to 0.0055% total N, 0.25 to 0.32% Mn, and 0.0003 to 0.0118% C was prepared in a laboratory, heated to 1250° C., hot rolled, and immediately subjected to a heat treatment at 600° C. for 2 hours, which is simulated to an actual hot coiling. The hot rolled strip had a final thickness of 2.8 mm, and after acid pickling was subjected to cold rolling to 0.80 mm, followed by continuous heat treatment. The patterns of the continuous heat treatment are shown in FIG. 1. The pattern A comprises heating at about 10° C./sec., soaking at 700° C. for 40 seconds, and slow cooling.

The patterns B and C comprise slow heating to 400° C., rapid heating from 400° C. to the soaking temperature at a rate of 100° C./sec., soaking at 700° C. for 15 seconds (B) and at 850° C. for 5 seconds (C), and rapid cooling at a rate of about 150° C./sec. None the patterns A, B and C comprises an over-ageing treatment.

Figure 2:
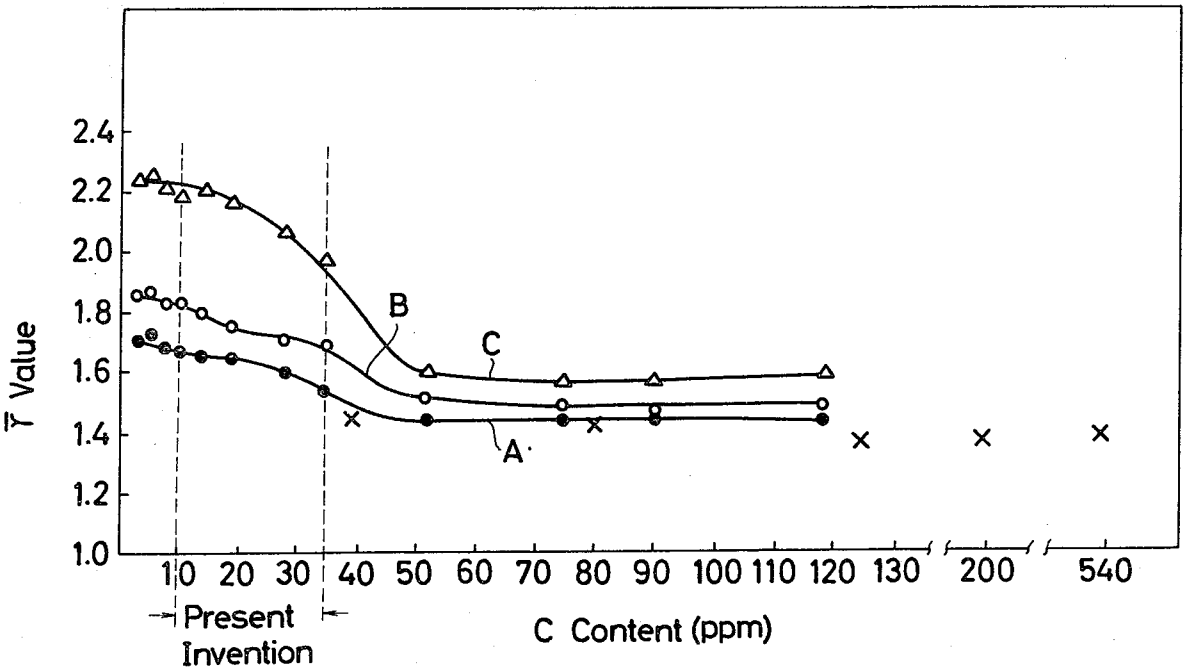
FIG. 2 is a graph showing the relation between the carbon content and the $\bar{r}$ value of the strip steels.

The relation between the $\bar{r}$ value and the carbon content of the resultant steel sheets is shown in FIG. 2. As clearly shown by the graph, when the carbon content is in a range exceeding 0.0040% (40 ppm), the $\bar{r}$ value is low, and does not change substantially if the carbon content varies in this range. Whereas, when the carbon content is 0.0035% (35 ppm) or less, the $\bar{r}$ value suddenly increase to more than 1.5, in all of the patterns A, B and C, thus satisfying the requirement of a deep-drawing steel sheet.

Even when the heating rate is relatively slow as in the case of A, and the carbon content is 0.0035% (35 ppm) or less, a $\bar{r}$ value of 1.5 or higher can be secured, and when the heating rate is increased to 100° C./sec. as in B, a still higher $\bar{r}$ value can be obtained. This tendency is remarkable particularlly with carbon contents not larger than 0.0035% and a $\bar{r}$ value of 1.7 or higher can be easily obtained. Further, when the soaking temperature is enhanced to 850° C., a very high $\bar{r}$ value as 2.0 or larger can be obtained with carbon contents not larger than 0.0035% even by a very short soaking time as 5 seconds.

Conventionally, trials were made to produce a cold rolled steel sheet from a low-carbon Al-killed steel composition by a continuous annealing. For example, U.S. Pat. No. 3,821,031 discloses a method comprising hot rolling Al-killed steel containing not larger than 0.010% C, and coiling the strip at 630° C. or higher, cold rolling and continuous annealing. The $\bar{r}$ value of the steel sheets obtained by the method of this prior art is shown in FIG. 2 with the mark X. As clearly shown, the $\bar{r}$ value obtainable by this prior art is between 1.46 and 1.39 even if the carbon content changes from 0.004% to 0.054%, and the effect of the carbon content on the variation of the $\bar{r}$ value is very small. U.S. Pat. No. 3,821,031 suggests nothing of the fact that when the carbon content is maintained at 0.0035% or less as in the present invention, the r value sharply increases, and this carbon range is very favourable for production of a deep-drawing steel sheet.

Figure 3:
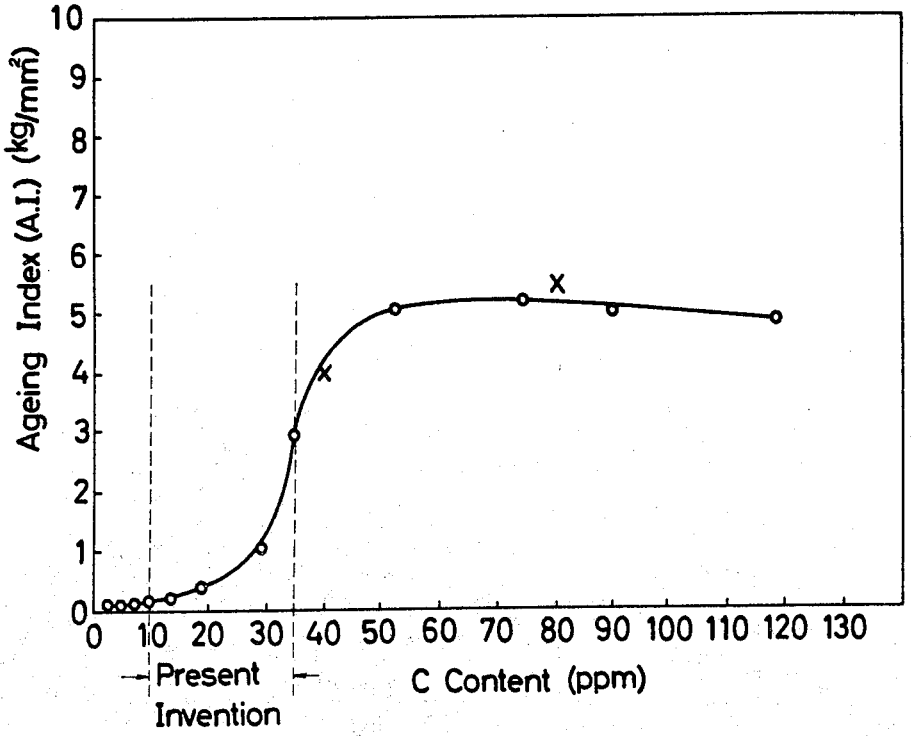
FIG. 3 is a graph showing the relation between the carbon content and A.I. of the steel material of the heat pattern A.

Then the present inventors have conducted experiments the ageing property of the test pieces as mentioned hereinbefore. The relation between the carbon content and A.I. (ageing index) of the steel sheet having the heat pattern A shown in FIG. 1 is shown in FIG. 3. In the present invention directed to a non-ageing steel sheet, the resultant A.I. value must be 3 kg/mm$^2$ or less, more preferably 1 kg/mm$^2$ or less. For this purpose, the carbon content must be 0.0035% (35 ppm) or less as shown in FIG. 3. For comparison, A.I. values obtained by the prior art, U.S. Pat. No. 3,821,031 are also shown in FIG. 3. They are higher than the upper limit (3 kg/mm$^2$) of A.I. in the present invention, and they are experimental data obtained with carbon contents not lower than 0.004% (40 ppm). Therefore, it is clear that the prior art is not directed to a non-ageing steel sheet.

Then, the relation between the secondary work cracking and the carbon content will be described below. The estimation of the secondary work cracking is done by deep-drawing a steel disc of 50 mm in diameter by means of a conical cup tester and measuring the susceptibility to brittle fracture developing from the edge of the cup when pressed from both sides at 0° C. When the crack length in this test is within 2 mm, there is no danger of development of the secondary work cracking in an ordinary pressing practice.

Figure 4:
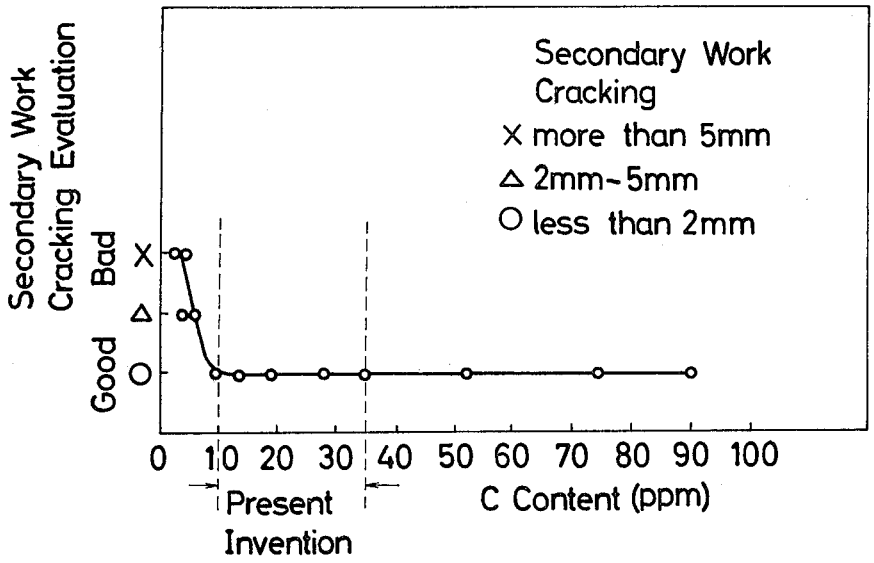
FIG. 4 is a graph showing the relation between the carbon content and the secondary work cracking in the steel material of the heat pattern A.

The results of the secondary work cracking tests using the same materials as in FIG. 3 are shown in FIG. 4. As clearly shown, when the carbon content is less than 0.0010% (10 ppm), the secondary work cracking develops. Therefore, in order to avoid this cracking, it is necessary that the carbon content must be at least 0.0010% (10 ppm).

Description will be made regarding the effects of the coiling temperature in the hot rolling step.

Figure 5:
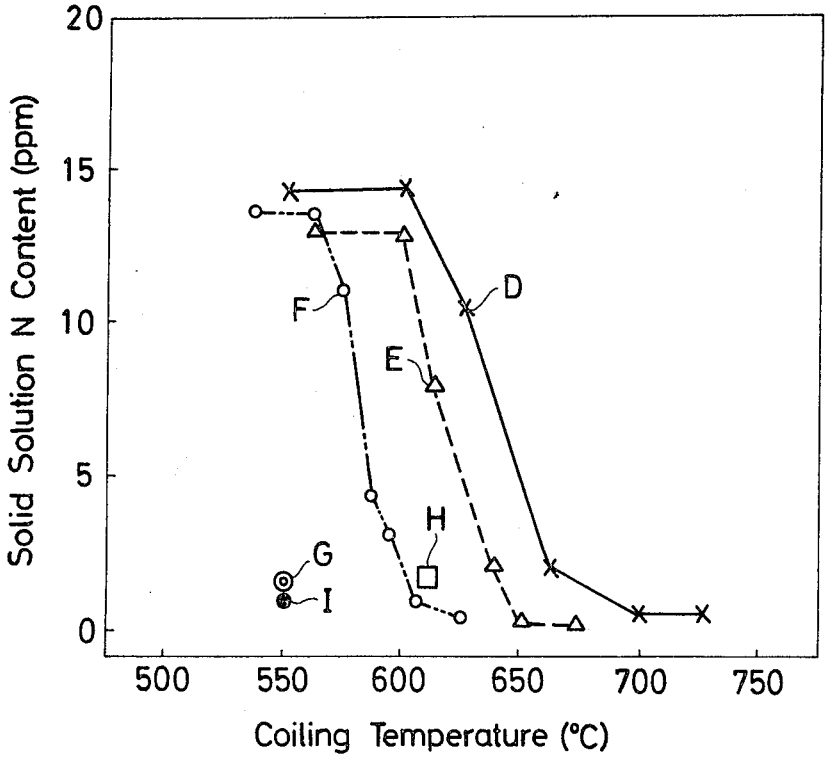
FIG. 5 is a graph showing effects by the carbon content and the coiling temperature on the amount of nitrogen in solid solution.

By conducting experiments, D, E, F, G, H and I illustrated in FIG. 5, the relation between the coiling temperature and the amount of the residual nitrogen in solid solution as measured by the internal friction has been examined in various steps.

In the present invention directed to a non-ageing steel sheet, it is essential that the nitrogen has already precipitated as AlN in the hot rolled state and substantially no nitrogen remains in solid solution.

In the experiments D, E and F, an Al-killed steel containing 0.045% C, 0.008% C and 0.002% C respectively was continuously cast, cooled once to the room temperature to obtain a slab, which slab was heated to 1250° C., continuously hot rolled and coiled at various temperatures to measure the amount of nitrogen in solid solution. The results are shown in FIG. 5.

In the experiment D where the carbon content is 0.045%, the coiling temperature must be not lower than 650° C. in order to maintain the nitrogen in solid solution at 5 ppm or less, and in the experiment E where the carbon content is 0.008%, the coiling temperature must be not lower than 625° C. in order to maintain the same level of nitrogen in solid solution. While in the experiment F where the carbon content is very small as 0.0020%, the coiling temperature may be not lower than 580° C. in order to maintain the same level of nitrogen in solid solution. Although the reason why the lower limit of the coiling temperature for decreasing the nitrogen in solid solution lowers as the carbon content decreases has not been clarified, but the following assumption may be made. The precipitation rate of AlN is far more rapid in the ferrite phase than the austenite phase, and in the ferrite phase the precipitation becomes quicker at a higher temperature so that when the carbon content is low and the $Ar_3$ transformation point is high as in the present invention, the retention time in the high temperature ferrite zone where the precipitation rate of AlN is rapid is longer and thus the precipitation of AlN is promoted.

In the experiment G, an Al-killed steel containing 0.0020% C. was heated to 1100° C. which was lower than the ordinary heating temperature, and at which Al and N were not yet fully dissolved in solid solution, and then hot rolled and coiled at 550° C. In spite of the low coiling temperature of 550° C., the nitrogen in solid solution was very small as 2 ppm or less. Thus the promotion of AlN precipitation by a low temperature slab heating is very effective to lower the lower limit of the coiling temperature.

In the experiment H, an Al-killed steel containing 0.002% C. was continuously cast to obtain high temperature slabs (about 1050° C.), which was introduced directly into a heating furnace at 1100° C. for 30 minutes without cooling to temperature lower than about 880° C., then hot rolled and coiled at 610° C. In this case, Al and N should have been almost completely decomposed and dissolved in solid solution before the hot rolling, but with a coiling temperature of 610° C., AlN fully precipitated and the amount of nitrogen in solid solution was found to be 2 ppm or less.

Lastly in the experiment I, an Al-killed steel containing 0.002% C was continuously cast to obtain hot slabs which were cooled to 800° C., at which held for 2 hours, then heated to 1100° C. continuously hot rolled and coiled at 550° C. In this case, AlN was caused to completely precipitated at 800° C. which is lower than the $Ar_3$ transformation point, and during the subsequent low temperature heating at 1100° C., Al and N were not completely dissolved in solid solution and part of them precipitated as AlN before the hot rolling. The results show that the nitrogen in solid solution decreased to 1 ppm even with a coiling temperature of 550° C.

It may be concluded from the forgoing experimental results that when the carbon content is as low as from 0.0010 to 0.0035% as in the present invention, it is possible to maintain the amount of nitrogen in solid solution not larger than 5 ppm in the coiled hot rolled steel strip even when the sol.Al content is as small as 0.018% and even when Al and N are completely dissolved in solid solution before the continuous hot rolling, so far as the coiling temperature is not lower than 580° C. Also in the case where the continuous hot rolling is done after parts of Al and N have already precipitated as AlN, it is possible to decrease the amount of nitrogen in solid solution satisfactorily with a coiling temperature not lower than 530° C.

Meanwhile, a more complete non-ageing property can be obtained by increasing the amount of sol.Al, but this measure causes increases in the production cost. Therefore, in the present invention, the upper limit of sol.Al is set at 0.090%.

In the present invention, the carbon content is defined to be not larger than 0.0035% (35 ppm) for the purpose of improving the deep-drawability. The present inventors have conducted studies on a method for further improving the deep-drawability and have established the following technical conditions.

Al-killed steels containing respectively 0.002% C and 0.045% C were cold rolled with various reduction rates prior to the heat treatment, and then subjected to soaking at 850° C. for 5 seconds (heating rates of 10° C./sec. and 100° C./sec.) so as to see the changes in the $\bar{r}$ value caused by the various cold rolling reduction rates. The results are shown in FIG. 6.

In the case (J) where the carbon content is as high as 0.045%, the peak of the r value comes when the reduction rate is 70%, but the increase in the absolute value is not so high. However, when the carbon content is 0.002% (K and L), the $\bar{r}$ value shows a very high peak at 80% reduction. In these cases, the reduction rates corresponding to the peak values are not substantially affected by the heating rate in the heat treatment. However, the general tendency is that the absolute $\bar{r}$ value is higher as the heating rate is higher (L).

Figure 6:
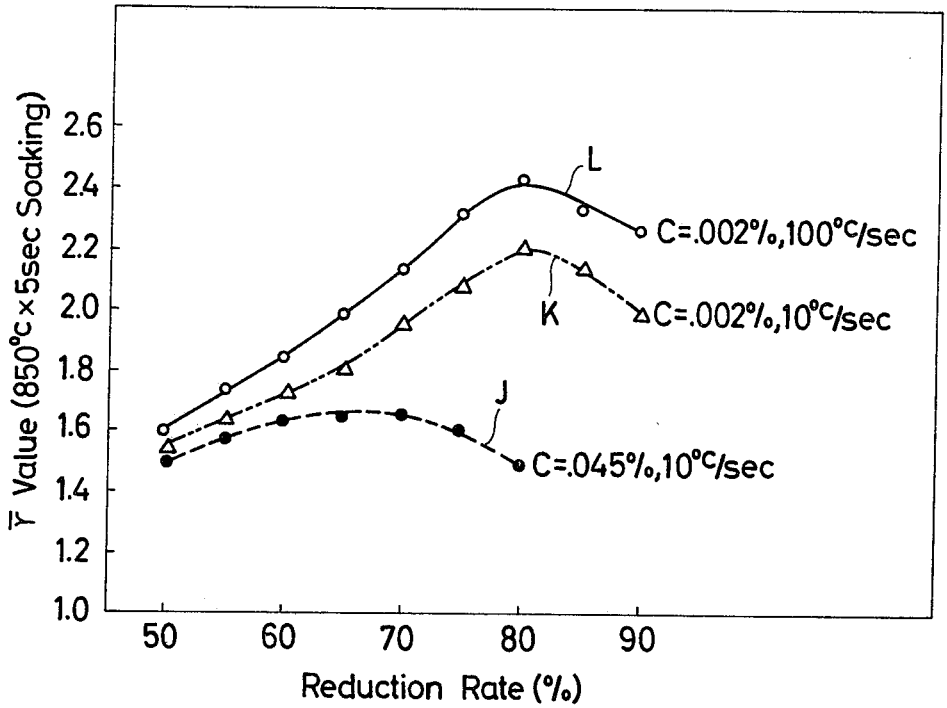
FIG. 6 is a graph showing the relation between the reduction rate and the $\bar{r}$ value.

The reduction rate normally employed in production of ordinary cold rolled steel sheets is about 70%, but as clearly shown in FIG. 6, when the carbon content is as low as 0.0035% or less, the $\bar{r}$ value obtainable with a reduction rate from 75% to 85% becomes very high as compared with that obtainable by the normal reduction rate.

The present inventors have made further studies for securing a high $\bar{r}$ value in connection with an extremely low carbon Al-killed steel, and have found that the predominant factor in this case was the effect by the heating rate.

Figure 7:
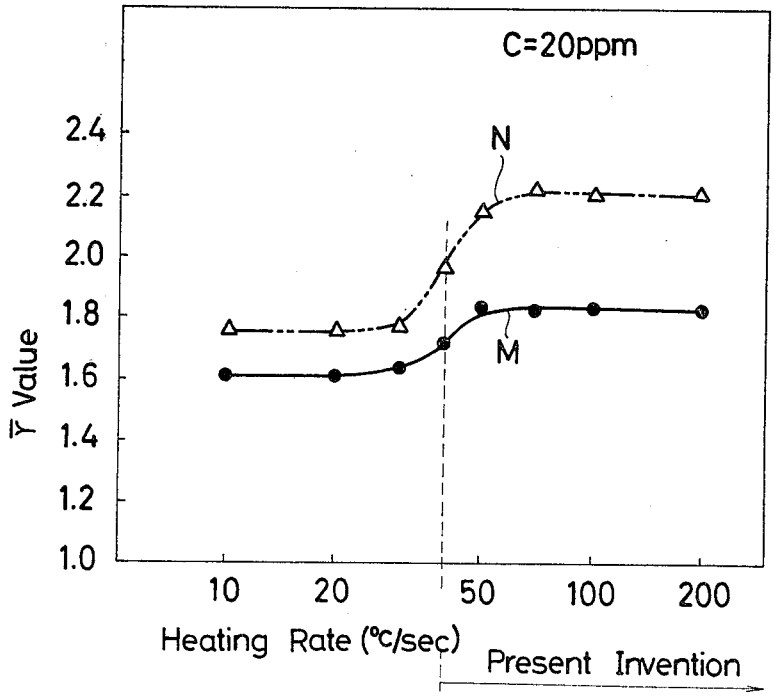
FIG. 7 is a graph showing the relation between the heating rate and the $\bar{r}$ value.

In the continuous heat treatment following the cold rolling of an Al-killed steel containing 0.0019% (carbon) (19 ppm) with 70% reduction, the heating rate from 600° C. to the soaking temperature was changed within the range from 10° C./sec. to 200° C./sec. to see corresponding changes in the $\bar{r}$ value. The results are shown in FIG. 7, in which M represents soaking at 700° C. for 15 seconds and N represents soaking at 850° C. for 5 seconds. The results reveal that if the heating rate increases to 40° C./sec. or larger, the $\bar{r}$ value begins to gradually increase, and at a heating rate between 50° and 60° C./sec., the $\bar{r}$ value approaches to a constant high value. Further at higher soaking temperatures, the increasing effect of the $\bar{r}$ value by the increased heating rate is more remarkable.

The reason why the $\bar{r}$ value is increased when the heating rate is increased in the expremely low carbon Al-killed steel in particular has not been clarified, however, it is assumed that the increased heating rates provide a more favourable condition for the growth of grains having an orientation suited for increasing the $\bar{r}$ value.

The forgoing descriptions have been made limitedly in connection with production of a non-ageing cold rolled steel strip having an excellent deep-drawability from an Al-killed steel by a continuous heat treatment without over-ageing. The desired results of the present invention can also be obtained when the steel material is passed through a continuous annealing furnace annealed to an over-ageing furnace.

Also a continuous annealing line as used in the production of steel substrates for electro-tin plating, or a hot-dip zinc coating line may be used for obtaining metal coating substrates within the scope of the present invention.

EXAMPLE

Four grades of molten steel having the following compositions were prepared in an oxygen converter and a degassing vessel, and continuously cast.

(1) C: 0.0020%, Mn: 0.28%, N: 0.0029%

(2) C: 0.0020%, Mn: 0.24%, sol.Al: 0.018%, N: 0.0050%

(3) C: 0.0020%, Mn: 0.24%, sol.Al: 0.059%, N: 0.0047%

(4) C: 0.0080%, Mn: 0.25%, sol.Al: 0.053%, N: 0.0052%

The slabs thus obtained were cooled to the room temperature, then heated to 1250° C. or 1100° C., and hot rolled with various coiling temperatures to obtain hot rolled strips of 2.8 mm thick.

Simultaneously, experiments were done by charging high temperature slabs at 1050° C. in the heating furnace at 1100° C. immediately after the continuous casting and continuously hot rolling the slabs, or by keeping slabs which were cooled to 800° C. after the continuous casting at the temperature for 2 hours, charging the slabs in a heating furnace at 1100° C. and then hot rolling.

The hot rolled steel strips of 2.80 mm thick were acid-pickled, cold rolled to 0.80 mm and 0.60 mm in thickness and subjected to a continuous heat treatment under the following conditions.

The heating rate from 400° C. or higher:

10° C./sec. or 100° C./sec.

The soaking temperature:

700° C.×15 sec.

700° C.×40 sec.

850° C.×5 sec.

The cooling rate:

about 10° C./sec. or about 150° C./sec.

For comparison, an over-ageing treatment at 400° C. for 120 seconds was performed after the soaking. All of the materials were given 10% temper rolling to determine the material quality.

The experimental conditions and the resultant properties are shown in the tables herein attached.

The results reveal that the steel 1 containing no sol.Al shows a relatively very high A.I. value of 4.8 kg/mm$^2$, thus failing to satisfy the requirement of a non-ageing steel sheet. If the amount of sol.Al is not lower than 0.018% (steels 2–15) the A.I. becomes 3 kg/mm$^2$ or less except for the steels 10 and 11 containing a large amount of carbon and the steel 9 in which the coiling temperature is low relative to the heating temperature.

Also in the case of the present invention, where the heating temperature is 1250° C., and Al and N are completely in solid solution (steels 2–8 and 12 are also within the scope of the present invention because Al and N are completely in solid solution), the A.I. becomes 3 kg/mm$^2$ or less with a coiling temperature at 590° C. or higher. Further with the low temperature heating at 1100° C. (steels 13, 14 and 15), the non-ageing property can be maintained with a coiling temperature of 550° C.

Meanwhile, in the case of the steels 10 and 11 containing a large amount of carbon, the $\bar{r}$ value remains to be as small as 1.60 or less even with a high temperature soaking at 850° C., but the steels 2–8 and 12–15 containing a less amount of carbon, the $\bar{r}$ value is higher than 1.60. A higher r value can be obtained by increasing the soaking temperature (as seen in the steels 2, 4, 6, 8, 12, 13, 14 and 15) but a still higher $\bar{r}$ value can be obtained by the high heating rate of 100° C./sec. from 400° C. to the soaking temperature (as seen in the steels 4, 7, 8, 13, 14 and 15) and also a still higher $\bar{r}$ value can be obtained with 80% cold rolling reduction (as seen in the steels 4, 7 and 14). With the most favourable conditions (steels 4, 7 and 14) the $\bar{r}$ value increases to 2.40 or higher.

In the present invention, no over-ageing treatment is required, but as shown in the steel 7, any heat treatment equivalent to the over-ageing treatment may be added within the scope of the present invention.

No secondary work cracking takes place in the present invention in which 0.0020% carbon is contained.

As clearly understood from the forwarding description and embodiments a non-ageing cold rolled steel strip with excellent deep-drawability can be obtained by the continuous heat treatment according to the present invention even without an over-ageing treatment.

| Steel | | Composition (%) | | | | Slab Heating | Hot Rolling | | Hot Rolled | Cold Rolled | Cold Rolling |
|---|---|---|---|---|---|---|---|---|---|---|---|
| No. | Designation | C | Mn | sol. Al | N | Temperature °C. | E.T. °C. | C.T. °C. | Sheet mm | Sheet mm | Reduction % |
| 1 | Comparison | 0.0020 | 0.28 | — | 0.0029 | 1250 | 875 | 610 | 2.8 | 0.80 | 71 |

-continued

| | | | | | | | | | | | |
|---|---|---|---|---|---|---|---|---|---|---|---|
| 2 | Present Invention | 0.0020 | 0.24 | 0.018 | 0.0050 | 1250 | 870 | 590 | 2.8 | 0.80 | 71 |
| 3 | Present Invention | 0.0020 | 0.24 | 0.059 | 0.0047 | 1250 | 880 | 600 | 2.8 | 0.80 | 71 |
| 4 | Present Invention | 0.0020 | 0.24 | 0.059 | 0.0047 | 1250 | 880 | 600 | 2.8 | 0.60 | 80 |
| 5 | Present Invention | 0.0020 | 0.24 | 0.059 | 0.0047 | 1250 | 880 | 600 | 2.8 | 0.80 | 71 |
| 6 | Present Invention | 0.0020 | 0.24 | 0.059 | 0.0047 | 1250 | 880 | 600 | 2.8 | 0.60 | 80 |
| 7 | Present Invention | 0.0020 | 0.24 | 0.059 | 0.0047 | 1250 | 880 | 600 | 2.8 | 0.80 | 80 |
| 8 | Present Invention | 0.0020 | 0.24 | 0.059 | 0.0047 | 1250 | 875 | 670 | 2.8 | 0.80 | 71 |
| 9 | Comparison | 0.0020 | 0.24 | 0.059 | 0.0047 | 1250 | 875 | 560 | 2.8 | 0.80 | 71 |
| 10 | Comparison | 0.0080 | 0.25 | 0.053 | 0.0052 | 1250 | 875 | 650 | 2.8 | 0.80 | 71 |
| 11 | Comparison | 0.0080 | 0.25 | 0.053 | 0.0052 | 1250 | 870 | 600 | 2.8 | 0.80 | 71 |
| 12 | Present Invention | 0.0020 | 0.24 | 0.059 | 0.0047 | Continuously cast high-temperature slab (1050° C.) was directly charged in a heat up furnace when the slab was heated to 1100° C. | 865 | 610 | 2.8 | 0.80 | 71 |
| 13 | Present Invention | 0.0020 | 0.24 | 0.059 | 0.0047 | 1100 | 865 | 550 | 2.8 | 0.80 | 71 |
| 14 | Present Invention | 0.0020 | 0.24 | 0.059 | 0.0047 | 1100 | 865 | 550 | 2.8 | 0.60 | 80 |
| 15 | Present Invention | 0.0020 | 0.24 | 0.059 | 0.0047 | Continuously cast low-temperature slab was held at 800° C. for 2 hours, and heated to 1100° C. in a heating furnace | 870 | 550 | 2.8 | 0.80 | 71 |

| | | Continuous Heat Treatment | | | Mechanical Properties | | | | | |
|---|---|---|---|---|---|---|---|---|---|---|
| Steel No. | Designation | Heating Rate °C./sec. | Soaking °C. × sec. | Cooling Rate °C./sec. | Y.P. kg/mm² | T.S. kg/mm² | El. % | r̄ value | A.I. (100° C. × 1 hr.) Ageing kg/mm² | Secondary* Work Cracking Test |
| 1 | Comparison | 100 | 700 × 15 | 150 | 21.0 | 32.9 | 43.9 | 1.75 | 4.8 | Δ |
| 2 | Present Invention | about 10 | 850 × 5 | about 10 | 18.9 | 29.9 | 46.5 | 2.18 | 1.0 | O |
| 3 | Present Invention | 100 | 700 × 15 | about 10 | 21.1 | 33.0 | 44.1 | 1.82 | 0.5 | O |
| 4 | Present Invention | 100 | 850 × 5 | 150 | 18.3 | 29.5 | 46.5 | 2.43 | 0.5 | O |
| 5 | Present Invention | about 10 | 700 × 40 | about 10 | 20.6 | 32.4 | 44.4 | 1.61 | 0.4 | O |
| 6 | Present Invention | about 10 | 850 × 5 | 150 | 19.0 | 30.2 | 46.5 | 1.76 | 0.5 | O |
| 7 | Present Invention | 100 | (°C.) (s) (°C.) (s) 850 × 5 + 400 × 120 followed by heat treatment equivalent to over-ageing | 150 | 18.2 | 29.0 | 46.4 | 2.42 | 0.5 | O |
| 8 | Present Invention | 100 | 850 × 5 | 150 | 18.2 | 28.2 | 46.9 | 2.20 | 0.3 | O |
| 9 | Comparison | about 10 | 700 × 40 | about 10 | 21.2 | 33.3 | 45.3 | 1.64 | 3.8 | O |
| 10 | Comparison | 100 | 850 × 5 | 150 | 22.4 | 34.6 | 45.1 | 1.58 | 5.3 | O |
| 11 | Comparison | 100 | 850 × 5 | 150 | 23.4 | 35.0 | 44.8 | 1.56 | 5.8 | O |
| 12 | Present Invention | about 10 | 850 × 5 | about 10 | 19.2 | 30.3 | 46.6 | 1.75 | 0.4 | O |
| 13 | Present Invention | 100 | 850 × 5 | 150 | 17.7 | 28.4 | 47.2 | 2.13 | 0.3 | O |
| 14 | Present Invention | 100 | 850 × 5 | 150 | 18.0 | 29.2 | 46.8 | 2.44 | 0.4 | O |
| 15 | Present Invention | 100 | 850 × 5 | 150 | 17.8 | 29.3 | 47.1 | 2.14 | 0.2 | O |

*O : Crack length not longer than 2 mm
Δ: 2 mm to not longer than 5 mm
X : 5 mm or longer

What is claimed is:

1. A method for producing a non-ageing high workability, cold rolled steel strip having excellent deep-drawability by a continuous heat treatment, which comprises continuously hot rolling an Al-killed steel containing 0.0010 to 0.0035% C, not larger than 0.45% Mn, nitrogen in an amount not over 0.005%, 0.015 to 0.090% sol.Al from a temperature range where Al and N are completely in solid solution, coiling the hot rolled strip at a temperature not lower than 580° C., cold rolling the strip, rapidly heating the cold rolled strip, holding the strip at a soaking temperature ranging from 680° C. to 900° C. for a short time and cooling the strip, and in which the steel produced has a r value of at least 1.5, an ageing index of not over 3 kg/mm², and simultaneously the characteristic that no secondary work cracking is caused to occur.

2. A method according to claim 1, in which the rapid heating is done with a heating rate of not less than 40° C./sec. from 600° C. to the soaking temperature.

3. A method according to claim 1, in which the cold rolling is done with a reduction ranging from 75% to 85%.

4. A method for producing a non-ageing, high workability cold rolled steel strip having excellent deep drawability, which comprises continuously hot rolling an Al-killed steel slab containing a 0.0010 to 0.0035% C, not larger than 0.45 Mn, nitrogen in an amount not over 0.005%, 0.015 to 0.090% sol.Al from a temperature ranger where part of AIN formed in the steel is precipitated, coiling the hot rolled strip at a temperature not lower than 530° C., cold rolling the strip, rapidly heating the strip, holding the strip at a soaking temperature ranging from 680° C. to 900° C. for a short time and cooling the strip, and in which the steel produced has an r value of at least 1.5, an ageing index of not over 3 $kg/mm^2$, and simultaneously the characteristic that no secondary work cracking is caused to occur.

5. A method according to claim 4, in which the rapid heating is done with a heating rate not less than 40° C./sec. from 600° C. to the soaking temperature.

6. A method according to claim 4, in which the cold rolling is done at a reduction ranging from 75% to 85%.

* * * * *